US005375267A

United States Patent [19]

Davis

[11] Patent Number: 5,375,267

[45] Date of Patent: Dec. 27, 1994

[54] TOILET SEAT LIFTING DEVICE

[76] Inventor: Kip L. Davis, P.O. Box 7321, Nikiski, Ak. 99635

[21] Appl. No.: 138,989

[22] Filed: Oct. 12, 1993

[51] Int. Cl.[5] ..... A47K 13/10; E03D 9/00

[52] U.S. Cl. ..... 4/246.1; 4/222; 239/57

[58] Field of Search ..... 4/246.1, 222, 228.1, 4/661; 16/112, 123, 124; 239/51.5, 53, 55, 57

[56] References Cited

U.S. PATENT DOCUMENTS

| | | | |
|---|---|---|---|
| 123,398 | 2/1872 | Herlt | 16/123 |
| D. 309,091 | 7/1990 | Shepard | 4/246.1 X |
| 711,923 | 10/1902 | Fales | 239/57 |
| 1,672,226 | 6/1928 | Mitchell et al. | 16/123 |
| 1,851,225 | 3/1932 | Wesemann | 16/112 |
| 2,236,576 | 4/1941 | Loebner | 4/246.1 |
| 3,783,455 | 1/1974 | Vanderbrook | 4/246.1 X |
| 4,165,835 | 8/1979 | Dearling | 239/51.5 |
| 5,065,460 | 11/1991 | Currin | 4/246.1 X |
| 5,086,523 | 2/1992 | De Mott et al. | 4/246.1 |
| 5,123,130 | 6/1992 | Sanders | 4/661 |

*Primary Examiner*—Robert M. Fetsuga
*Attorney, Agent, or Firm*—Hugh E. Smith

[57] ABSTRACT

A device for lifting a toilet seat without the hands of the user directly contacting such seat wherein a flat plate is attached to the underside of the toilet seat, such flat plate having its outer end protruding only slightly beyond the edge of the seat. The said outer end is formed with a pair of downwardly angled flanges adapted to receive a pivot pin therethrough, such pivot pin extending through the end of a preferably tubular handle. The handle will normally depend from the said pivot pin but when it is to be used, such handle is lifted into a horizontal position, i.e. parallel with the seat surface, and used to raise the toilet seat. A stop is built into the outer end of the flat plate attached to the seat to prevent the pivoted handle from rising above the plane of the seat surface. Provision may be made for latching the handle into position during actual use and the handle may be used as a receptacle for deodorant if desired.

5 Claims, 4 Drawing Sheets

FIG 1
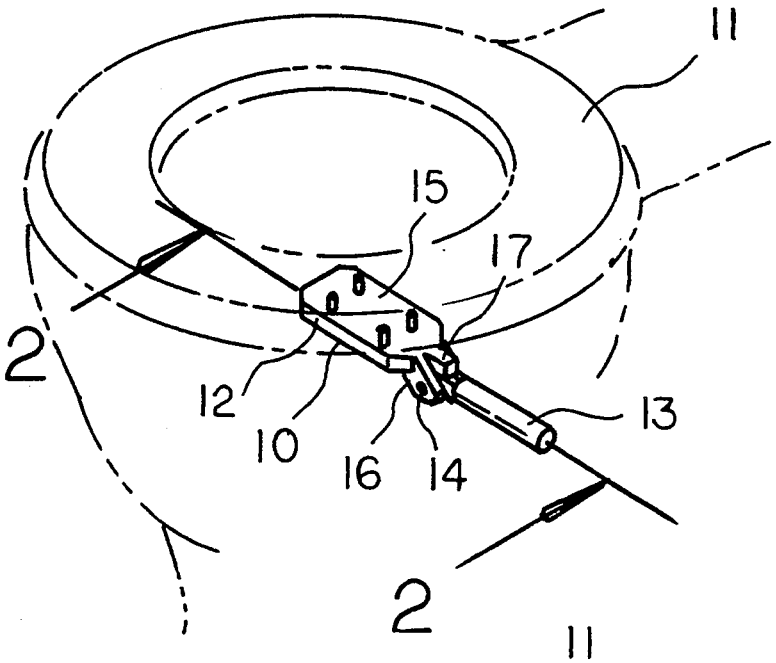
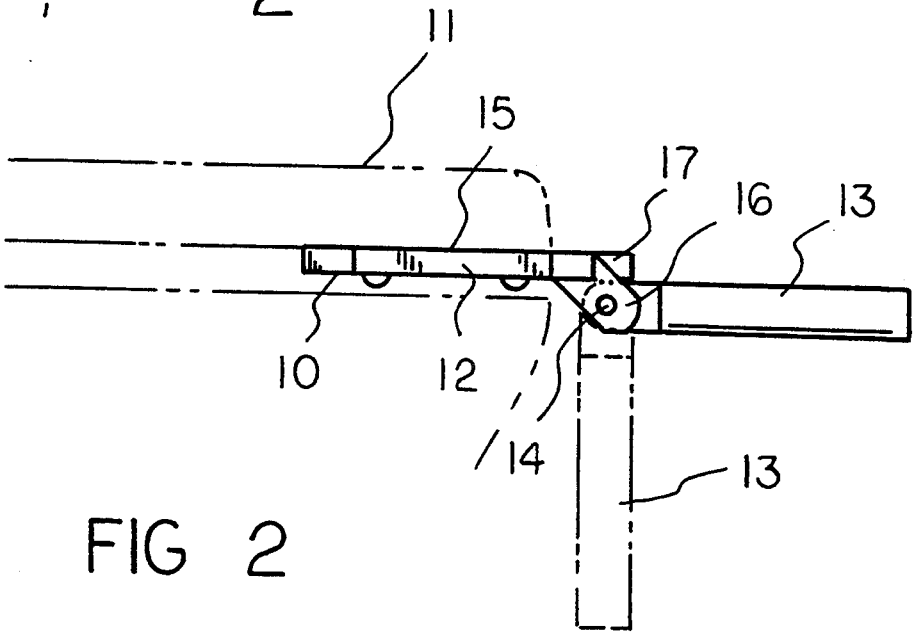
FIG 2

TOILET SEAT LIFTING DEVICE

BACKGROUND OF THE INVENTION

1. Field of the Invention

The present invention relates to toilet seats and more particularly pertains to a device which may be utilized to raise and lower a toilet seat without actually touching the seat with the hands.

2. Description of the Prior Art

The use of toilet seat lifters is known in the prior art. More specifically, such devices heretofore devised and utilized for the purpose of lifting toilet seats are known to consist basically of familiar, expected and obvious structural configurations, notwithstanding the myriad of designs encompassed by the crowded prior art which have been developed for the fulfillment of countless objectives and requirements. One failure on the part of such devices is the protrusion of the lifting handle when not in use causing possible safety problems and being unsightly. Typical of the devices known in the art are U.S. Pat. Nos. 4,805,246; 4,875,251; and 5,058,215 all of which show protruding handles for toilet seats adhesively or otherwise attached to the underside of such seats. A variation utilizing a pair of pivoted levers (also protruding at all times) is illustrated in U.S. Pat. No. 4,951,324.

In this respect, the device according to the present invention substantially departs from the conventional concepts and designs of the prior art, and in so doing provides an apparatus primarily developed for the purpose of lifting a toilet seat without being a safety hazard or disfiguring the toilet fixture.

Therefore, it can be appreciated that there exists a continuing need for new and improved toilet seat lifters. In this regard, the present invention substantially fulfills this need.

SUMMARY OF THE INVENTION

In view of the foregoing disadvantages inherent in the known types of toilet seat lifters now present in the prior art, the present invention provides an improved construction wherein the same can be utilized to safely and decoratively lift a toilet seat. As such, the general purpose of the present invention, which will be described subsequently in greater detail, is to provide a new and improved toilet seat lifter device which has all the advantages of the prior art devices and none of the disadvantages.

To attain this, the present invention essentially comprises a device for lifting a toilet seat without the hands of the user directly contacting such seat wherein a flat plate is attached to the underside of the toilet seat, such flat plate having its outer end protruding only slightly beyond the edge of the seat. The said outer end is formed with a pair of downwardly angled flanges adapted to receive a pivot pin therethrough, such pivot pin extending through the end of a preferably tubular handle. The handle will normally depend from the said pivot pin but when it is to be used, such handle is lifted into a horizontal position, i.e. parallel with the seat surface, and used to raise the toilet seat. A stop is built into the outer end of the flat plate attached to the seat to prevent the pivoted handle from rising above the plane of the seat surface.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved toilet seat lifter device which has all the advantages of the prior art devices and none of the disadvantages.

It is another object of the present invention to provide a new and improved toilet seat lifter device which may be easily and efficiently manufactured and marketed.

It is a further object of the present invention to provide a new and improved toilet seat lifter device which is of a durable and reliable construction.

An even further object of the present invention is to provide a new and improved toilet seat lifter device which is susceptible of a low cost of manufacture with regard to both materials and labor, and which accordingly is then susceptible of low prices of sale to the consuming public, thereby making such devices economically available to the buying public.

Still another object of the present invention is to provide a new and improved toilet seat lifter device wherein the handle does not protrude except when in use.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective view of the simplest form of the present invention in place on a toilet seat.

FIG. 2 is a side view of the device of FIG. 1.

DESCRIPTION OF THE PREFERRED EMBODIMENT

Figure 3:
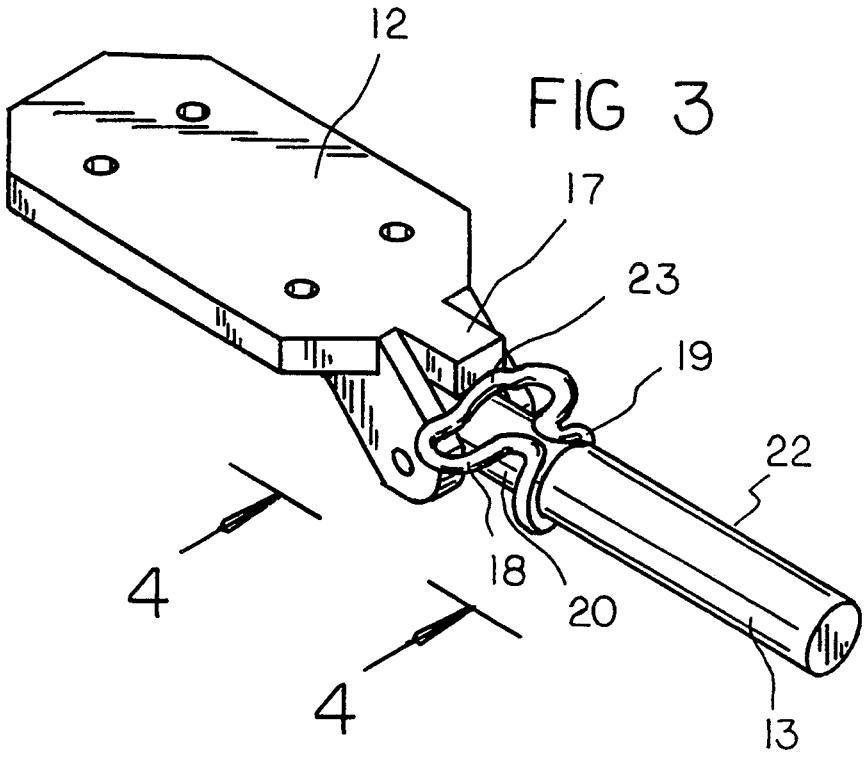
FIG. 3 is a perspective view of a preferred embodiment of the invention.

With reference now to the drawings, and in particular to FIG. 1 thereof, a new and improved toilet seat lifting device embodying the principles and concepts of the present invention and generally designated by the reference numeral 10 will be described.

More specifically, it will be noted that the device 10 fastens to the underside of a conventional toilet seat 11 (shown here in broken lines). Device 10 in its simplest form, consists of three elements: a support plate 12 affixed to the seat 11; a pivoted handle 13 extendible outwardly from support plate 12; and a pivot pin 14 for such handle, mounted in the end of plate 12. The support plate 12 has a flat, seat-contacting surface 15 affixed to the inner surface of the toilet seat 11 by screws as shown here or by means of adhesive or the like. Alternatively, support plate 12 may be molded internally with seat 11. Support plate 12 extends to or only slightly beyond the edge of the toilet seat 11 and terminates at the outer end thereof in three elements: a pair of downwardly extending angular flanges 16 and a short extension stub or stop member 17. Flanges 16 are drilled to accept a wedge-fit pivot pin 14. Such pivot 14 extends through the inner end of handle 13 with sufficient clearance as to allow handle 13 to rotate on pin 14. When not in use, the weight of handle 13 will cause such handle to drop to a substantially vertical position as shown in the broken lines of FIG. 2. In use, handle 13 is grasped by the user and raised to a substantially horizontal position (also as shown in FIG. 2) where the upper surface of handle 13 engages against the stop member 17 which prevents it from continuing its swing upward. At this point, handle 13 will cause the toilet seat 11 to be lifted into an upright position. Dropping seat 11 and releasing handle 13 will permit such handle 13 to drop, thereby eliminating an unsafe projection of said handle 13 from the toilet seat 11 and essentially restoring the toilet fixture to its normal appearance.

Figure 4:
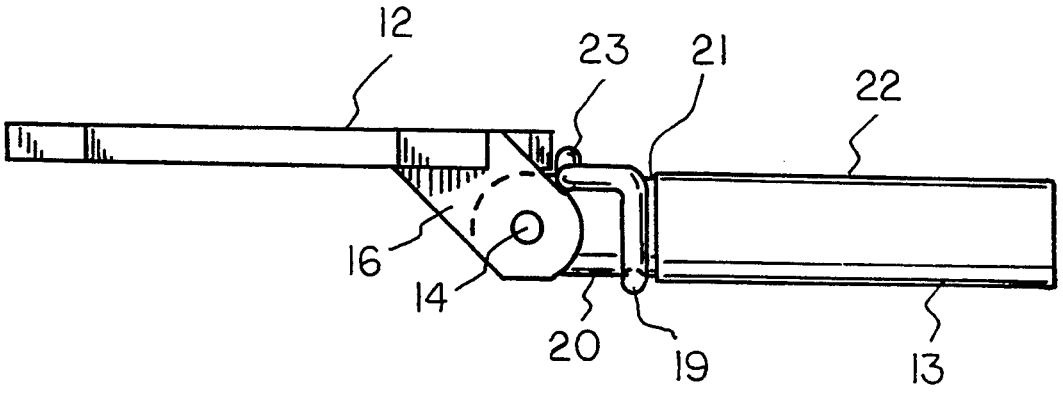
FIG. 4 is a side view of the device of FIG. 3.

To prevent damage to the handle portion 13 of device 10 and to the toilet to which it is affixed, a somewhat more elegant and preferred embodiment of device 10 is shown in FIG. 3 and subsequent drawings. Utilizing the same support plate 12 and a modified handle 13, a spring latch clip 18 is added to handle 13. The clip 18 is preferably formed of spring steel and has a portion 19 surrounding a reduced diameter portion 20 of the inner end of handle 13. This reduced diameter portion 20 of handle 13 through which pivot pin 14 extends results in a raised detent 21 formed with the main larger diameter portion 22 of handle 13. The wrap-around portion 19 of clip 18 thus is not free to slide towards the outer end of handle 13. The balance of clip 18 is formed with a loop portion 23 which, when handle 13 is raised into operative position as described in connection with FIGS. 1 and 2, engages with the ends of each of the flanges 16 and is deformed slightly to provide a frictional stop preventing handle 13 from falling under gravity alone to its normal inoperative, vertical position. Hence, if the toilet seat to which the device is fastened is lowered without use of the handle, the handle will not return to its normal inoperative position without positive displacement by the user to overcome the frictional resistance of clip 18. FIG. 4 shows the device of FIG. 3 with intentional enlargement of the clearance between clip 18 and stop 17 and raised detent 21 to more clearly illustrate their relative positions.

Figure 5:
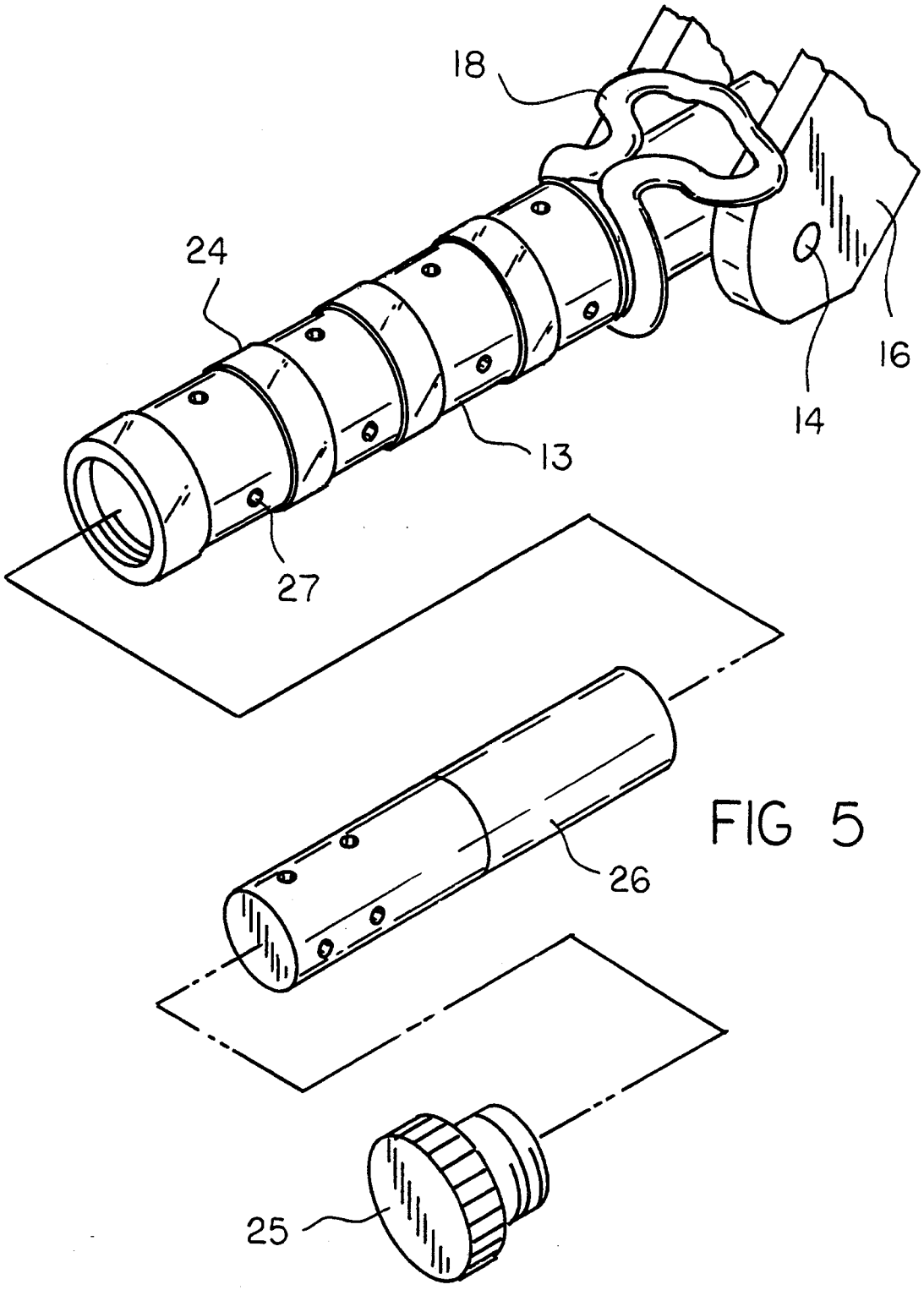
FIG. 5 is an exploded perspective view of a further modification of the device illustrated in FIGS. 3 and 4.
Figure 6:
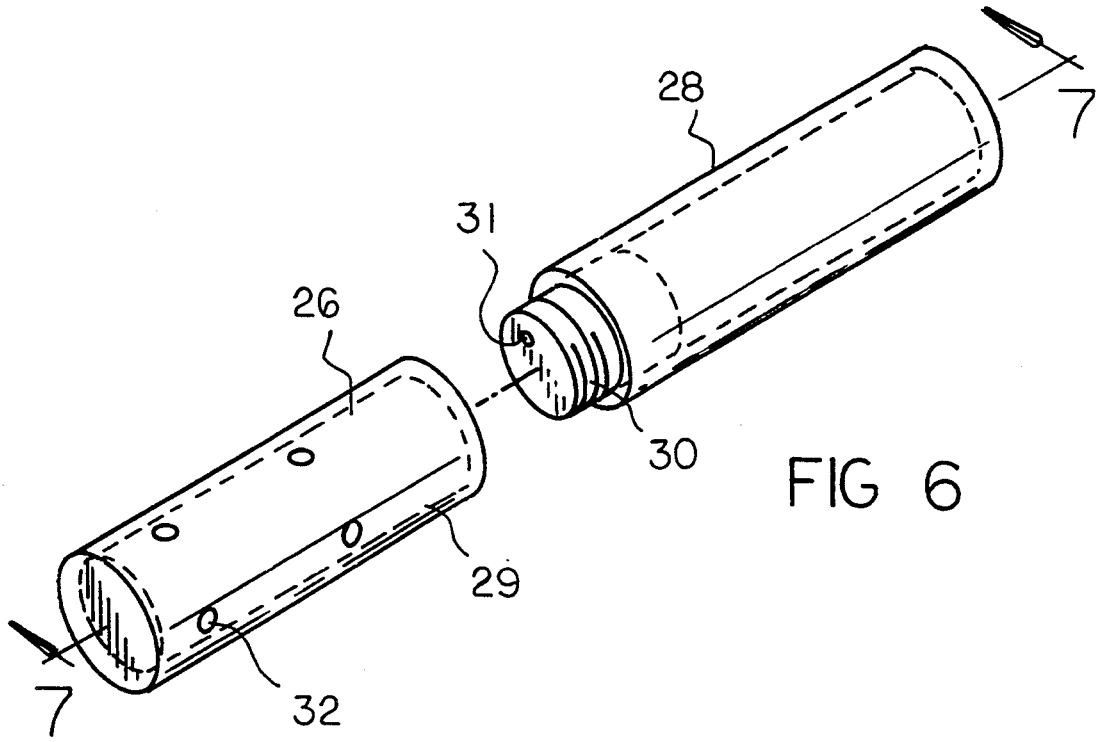
FIG. 6 is a perspective view of a portion of the modification shown in FIG. 5.
Figure 7:
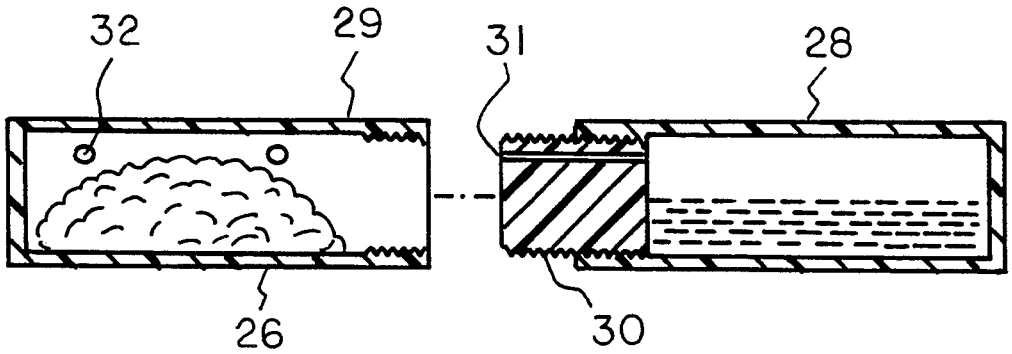
FIG. 7 is a sectional view taken on line 7—7 of FIG. 6.

FIGS. 5 through 7 illustrate modifications which may be incorporated into device 10 as illustrated in the preceding drawings. With reference to FIG. 5, the handle 13 may be made more visible, particularly for nighttime use, by forming it of a fluorescent coated plastic or as shown here by applying strips 24 of adhesive backed fluorescent tape around handle 13. Also as shown in FIG. 5, the tubular handle member 13 may be utilized for an additional function to that of providing a lifting means for a toilet seat. Such handle 13, which usually will be hollow in every instance, may be provided with a threaded end cap 25 permitting access to the interior of such handle 13. A replaceable deodorizer cartridge 26 of suitable tubular dimensions and shape may thus be inserted within the interior of handle 13. In such instance, a plurality of perforations 27 are provided extending into the interior of handle 13 to permit release of the deodorizer vapor from such cartridge to the ambient area.

FIGS. 6 and 7 detail one version of such a deodorizer cartridge 26 especially adapted for use as shown in FIG. 5. Cartridge 26 is formed by two cylinders which thread together. One cylinder 28 is adapted to hold a liquid element (usually water) of the deodorant system, while the second cylinder 29 holds a solid or powdered scent-producing element thereof. Extending through the solid threaded end 30 of cylinder 29 and communicating with the interior of cylinder 28 is a very small diameter weep hole 31. When handle 13 (in which cartridge 26 is enclosed) is in its normal inoperative vertical position, the liquid from cylinder 28 will very slowly seep into cylinder 29 activating the scent-producing element therein and causing the vapor so produced to exit from the holes 32 in cylinder 28 and thence from the holes 27 in the handle member 13 as shown in FIG. 5.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A device for lifting a toilet seat without direct hand contact with such seat which comprises: a rigid, flat plate adapted to be affixed to an undersurface of the toilet seat, said plate extending substantially to the edge of the toilet seat and terminating in a pair of downwardly extending rigid flanges and, disposed therebetween in the same plane as said flat plate, a short extension stub integral with said flat plate; a pivot pin mounted between said rigid flanges; and a tubular handle pivotally mounted on said pivot pin, said handle normally depending in a substantially vertical position until raised to a substantially horizontal position by the user and when so raised engaging its upper surface against said short extension stub which inhibits further independent travel of said handle and causes said handle to then lift the toilet seat;

wherein a spring latch clip is affixed to said handle to frictionally engage said flanges when said handle is lifted into a horizontal position.

2. A device as in claim 1, wherein said handle has a reduced diameter portion adjacent said pivot pin to provide with the non-reduced portion an abutment engaging said spring latch clip and restricting the movement thereof to permit frictional engagement with said flanges to prevent said handle from dropping to the vertical position when released by the user.

3. A device as in claim 1, wherein said handle is a perforated hollow cylinder closed by a removable cap; and a replaceable deodorizer cylinder is container within said hollow handle.

4. A device as in claim 1, wherein strips of fluorescent tape are wrapped about said handle.

5. A device for lifting a toilet seat without direct hand contact with such seat which comprises: a rigid, flat plate adapted to be affixed to an undersurface of the toilet seat, said plate extending substantially to the edge of the toilet seat and terminating in a pair of downwardly extending rigid flanges and, disposed therebetween in the same plane as said flat plate, a short extension stub integral with said flat plate; a pivot pin mounted between said rigid flanges; and a tubular handle pivotally mounted on said pivot pin, said handle normally depending in a substantially vertical position until raised to a substantially horizontal position by the user and when so raised engaging its upper surface against said short extension stub which inhibits further independent travel of said handle and causes said handle to then lift the toilet seat;

wherein said handle is a perforated hollow cylinder closed by a removable cap; and a replaceable deodorizer cylinder is container within said hollow handle.

* * * * *